US010997892B1

(12) United States Patent
Lan et al.

(10) Patent No.: US 10,997,892 B1
(45) Date of Patent: May 4, 2021

(54) DATA CACHING CIRCUIT, DISPLAY PANEL AND DISPLAY DEVICE

(71) Applicant: BOE TECHNOLOGY GROUP CO., LTD., Beijing (CN)

(72) Inventors: Ronghua Lan, Beijing (CN); Junrui Zhang, Beijing (CN); Xuehui Zhu, Beijing (CN); Zhidong Wang, Beijing (CN); Lijia Zhou, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/007,170

(22) Filed: Aug. 31, 2020

(30) Foreign Application Priority Data

Nov. 15, 2019 (CN) ..... 201911120068.2

(51) Int. Cl.
*G09G 3/20* (2006.01)

(52) U.S. Cl.
CPC ..... *G09G 3/20* (2013.01); *G09G 2310/0275* (2013.01); *G09G 2310/0286* (2013.01); *G09G 2310/08* (2013.01)

(58) Field of Classification Search
CPC ..... G09G 3/20; G09G 2310/08; G09G 2310/0286; G09G 2310/0275
See application file for complete search history.

(56) References Cited

U.S. PATENT DOCUMENTS

2002/0036610 A1* 3/2002 Ito ..... G09G 3/20 345/89
2002/0126071 A1* 9/2002 Kojima ..... G09G 3/20 345/60
2002/0180675 A1* 12/2002 Tobita ..... G09G 3/3233 345/87
2017/0124972 A1* 5/2017 Kim ..... G09G 3/3677

* cited by examiner

*Primary Examiner* — Andrew Sasinowski
(74) *Attorney, Agent, or Firm* — Thomas | Horstemeyer, LLP

(57) ABSTRACT

A data caching circuit includes a ring signal counter, a switch, and a first latch. An output terminal of the ring signal counter is connected to a control terminal of the switch. An output terminal of the switch is connected to a control terminal of the first latch. The ring signal counter is configured to input a data transmission starting signal and a clock signal to generate and output a count control signal. A clock signal terminal of the switch is configured to input the clock signal, and the switch is configured to generate and output a data caching control signal according to the input count control signal and clock signal. A data signal input terminal of the first latch is configured to input a data signal. The first latch is configured to latch the data signal according to the data caching control signal input from the control terminal of the first latch. An output terminal of the first latch is configured to output the data signal.

17 Claims, 5 Drawing Sheets

DATA CACHING CIRCUIT, DISPLAY PANEL AND DISPLAY DEVICE

CROSS-REFERENCE TO RELATED APPLICATION

The present disclosure claims the benefit of and priority to Chinese Patent Application No. 201911120068.2 filed Nov. 15, 2019, the entire contents of which are incorporated herein by reference.

TECHNICAL FIELD

The present disclosure relates to display technology and, more particularly, to a data caching circuit, a display panel, and a display device.

BACKGROUND

A data caching circuit in a display product drive circuit caches and outputs a data signal sent through a serial-to-parallel conversion circuit. Since data transmitted from the serial-to-parallel conversion circuit has different data formats, the data caching circuit in the prior art needs to design different control signals to control data in different formats for caching. The circuit structure of the data caching circuit in the prior art needs to add a large number of combined logic devices, thus occupying a large layout area and leading to high power consumption.

In summary, the generation of the control signals of the data caching circuit provided by the prior art is very complicated and the circuit also has a complex structure, a large area, and relatively high-power consumption.

SUMMARY

An embodiment of the present disclosure provides a data caching circuit, comprising: a ring signal counter, a plurality of switches, and a plurality of first latches;

wherein an output terminal of the ring signal counter is connected to control terminals of the switches;

an output terminal of one of the switches is connected to at least one control terminal of one or more of the first latches;

the ring signal counter is configured to input a data transmission starting signal and a clock signal, and generate and output a count control signal;

a clock signal terminal of the switch is configured to input the clock signal, and the switch is configured to generate and output a data caching control signal according to the count control signal input from the control terminal of the switch and the clock signal;

a data signal input terminal of the first latch is configured to input a data signal corresponding to a data format; the first latch is configured to latch the data signal according to the data caching control signal input from the control terminal of the first latch; and an output terminal of the first latch is configured to output the data signal.

The data caching circuit provided by the embodiment of the present disclosure only needs a set of count control signals to control the switches to complete complex data transmission during data transferring since the ring signal counter is used to count the data in different data formats and there is no need to design a circuit that generates different control signals for data in different data formats, which simplifies the circuit structure while simplifying the count control signals and also reduces the area and power consumption of the circuit.

In an exemplary embodiment, the ring signal counter comprises a starter and a plurality of cascaded second latches;

wherein the starter is configured to generate and output a count starting signal according to the input data transmission starting signal;

an input terminal of the second latch is connected to an output terminal of the starter or an output terminal of the second latch of the previous stage;

an output terminal of the second latch is connected to the control terminal of at least one of the switches, and an output terminal of the second latch of the last stage is connected to an input terminal of the starter;

control terminals of the plurality of cascaded second latches are configured to input the clock signal;

the second latch of the first stage is configured to: according to the count starting signal and the clock signal, selectively output the count control signal or a continuous low level signal through the output terminal of the second latch of the first stage; the second latches other than the second latch of the first stage are configured to: according to the count control signal and the clock signal output by the second latch of the previous stage, selectively output the count control signal or the continuous low level signal through the output terminal of the second latch.

In an exemplary embodiment, the starter comprises a first OR gate; wherein the first OR gate has a first input terminal configured to input the data transmission starting signal, an output terminal configured to output a count starting signal, and a second input terminal connected to the output terminal of the second latch of the last stage;

the second latch comprises a first transmission gate, a second transmission gate, a first NAND gate and a first NOT gate;

wherein an input terminal of the first transmission gate is connected to the output terminal of the first OR gate or the output terminal of the second latch of the previous stage, a first control terminal of the first transmission gate and a first control terminal of the second transmission gate are configured to input the clock signal, and a second control terminal of the first transmission gate and a second control terminal of the second transmission gate are configured to input a reverse signal of the clock signal;

an output terminal of the first transmission gate is connected to a second input terminal of the first NAND gate;

an input terminal of the second transmission gate is connected to an output terminal of the first NOT gate, and an output terminal of the second transmission gate is connected to the second input terminal of the first NAND gate;

a first input terminal of the first NAND gate is configured to input a reset signal, an output terminal of the first NAND gate is connected to an input terminal of the first NOT gate, and the first NAND gate selectively outputs the count control signal or the continuous low level signal through the output terminal of the first NAND gate.

In an exemplary embodiment, the switch comprises a third transmission gate, a fourth NOT gate, a fifth NOT gate, a sixth NOT gate and a first transistor;

wherein the third transmission gate has an input terminal configured to input the clock signal, a first control terminal connected to an output terminal of the fourth NOT gate, a second control terminal connected to an input terminal of the fourth NOT gate, and an output terminal connected to an input terminal of the fifth NOT gate;

the input terminal of the fourth NOT gate is connected to the output terminal of the second latch;

an output terminal of the fifth NOT gate is connected to an input terminal of the sixth NOT gate;

the first transistor has a control electrode connected to the output terminal of the fourth NOT gate, a first electrode connected to the input terminal of the fifth NOT gate, and a second electrode which is grounded;

an output terminal of the sixth NOT gate is connected to the control terminal of the first latch and the sixth NOT gate is configured to selectively output the clock signal or the continuous low level signal through the output terminal of the sixth NOT gate.

In an exemplary embodiment, the number of the switches is equal to the number of the second latches; the output terminal of the second latch is connected to the control terminal of one of the switches.

In this way, the number of the switches is minimized and the number of the first latches is also minimized since each of the switches is connected to the plurality of first latches. Therefore, the number of logic devices in the data caching circuit as well as the area and power consumption of the data caching circuit may be reduced to the maximum extent.

In an exemplary embodiment, the output terminal of each of the switches is connected to control terminals of three of the first latches.

In an exemplary embodiment, the first latch comprises a one-out-of-N data selector and a first logic combiner;

wherein the one-out-of-N data selector comprises N first AND gates, N fourth transmission gates and N seventh NOT gates;

the first logic combiner comprises a second NAND gate, an eighth NOT gate, a ninth NOT gate, a fifth transmission gate and a second OR gate;

a first input terminal of the first AND gate inputs a data indication signal; a second input terminal of the first AND gate inputs the data caching control signal; an output terminal of each of the first AND gates is connected to a second control terminal of one of the fourth transmission gates, and the output terminal of each of the first AND gates is connected to an input terminal of one of the seventh NOT gates; the output terminal of the first AND gate is connected to an input terminal of the second OR gate;

an input terminal of the fourth transmission gate is configured to input the data signal corresponding to the data format; a first control terminal of each of the fourth transmission gates is connected to an output terminal of one of the seventh NOT gates; an output terminal of the fourth transmission gate is connected to a second input terminal of the second NAND gate, and the output terminal of the fourth transmission gate is connected to an input terminal of the fifth transmission gate;

an output terminal of the second OR gate is connected to an input terminal of the ninth NOT gate, and the output terminal of the second OR gate is connected to a first control terminal of the fifth transmission gate; an output terminal of the fifth transmission gate is connected to an input terminal of the eighth NOT gate; a second control terminal of the fifth transmission gate is connected to an output terminal of the ninth NOT gate;

a first input terminal of the second NAND gate is configured to input a reset signal, and an output terminal of the second NAND gate is connected to the input terminal of the eighth NOT gate;

wherein N is an integer greater than 1 and N is a total number of data formats transmitted by the ring signal counter.

In an exemplary embodiment, the ring signal counter comprises four stages of second latches, the data caching circuit comprises four switches, and the first latch comprises a one-out-of-three data selector.

An embodiment of the present disclosure provides a display panel, comprising the above-mentioned data caching circuit provided by the embodiment of the present disclosure; the display panel further comprises: a serial-to-parallel conversion circuit and a pixel circuit; an input terminal of the ring signal counter is connected to an output terminal of the serial-to-parallel conversion circuit and the output terminal of the first latch is connected to the pixel circuit.

An embodiment of the present disclosure provides a display device, comprising the display panel provided by the embodiment of the present disclosure.

BRIEF DESCRIPTION OF THE DRAWINGS

A brief introduction will be made below to the accompanying drawings required for the description of embodiments, in order to illustrate technical solutions in embodiments of the present disclosure more clearly. Understandably, the drawings in the following description are only some embodiments of the present disclosure and those of ordinary skill in the art can also derive other drawings based on the drawings without doing any creative work.

DETAILED DESCRIPTION

Figure 1:
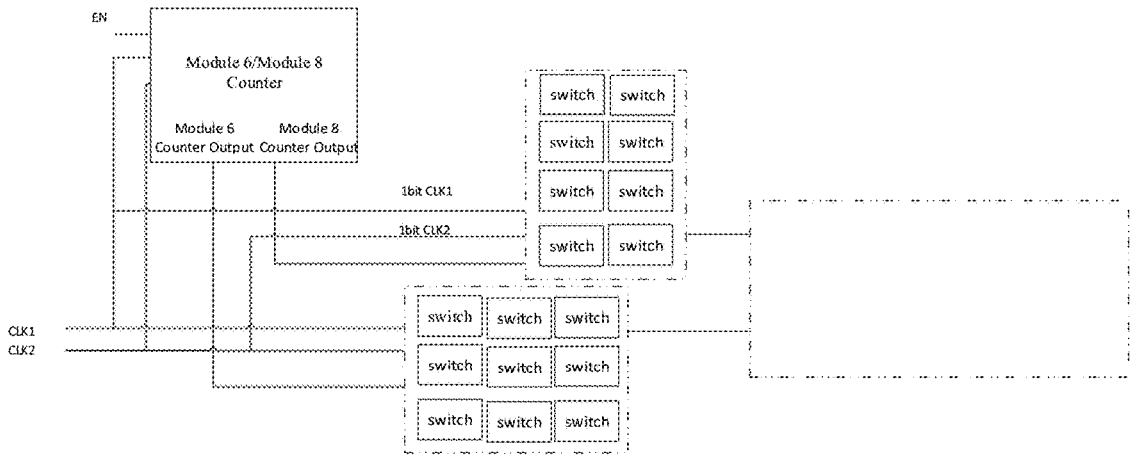
Fig. 1 (Prior Art)
FIG. 1 is a schematic structural diagram of a data caching circuit provided by the prior art.

In a solution of the prior art, counters with different module values are provided, as shown in FIG. 1, the counter includes a module 6 counter and a module 8 counter. A data count starting signal EN and clock signals CLK1, CLK2 are input to an input terminal of the counter. An output terminal of the module 6 counter is connected to a switch array including 12 switches and the module 6 counter is configured to count data in a 3 bit mode to control the switch array to generate a data caching control signal. An output terminal of the module 8 counter is connected to a switch array including 8 switches and the module 8 counter is configured to count data in a 4 bit mode to control the switch array to generate the data caching control signal. The switch array including 8 switches is also connected to a clock signal terminal of data in a 1 bit mode, and is configured to generate a data caching control signal of the data in the 1 bit mode. In addition, an output terminal of the switch array is connected to 12 one-out-of-six latches, and under the control of data caching control signals of different data formats, the data in different formats is cached.

Figure 2:
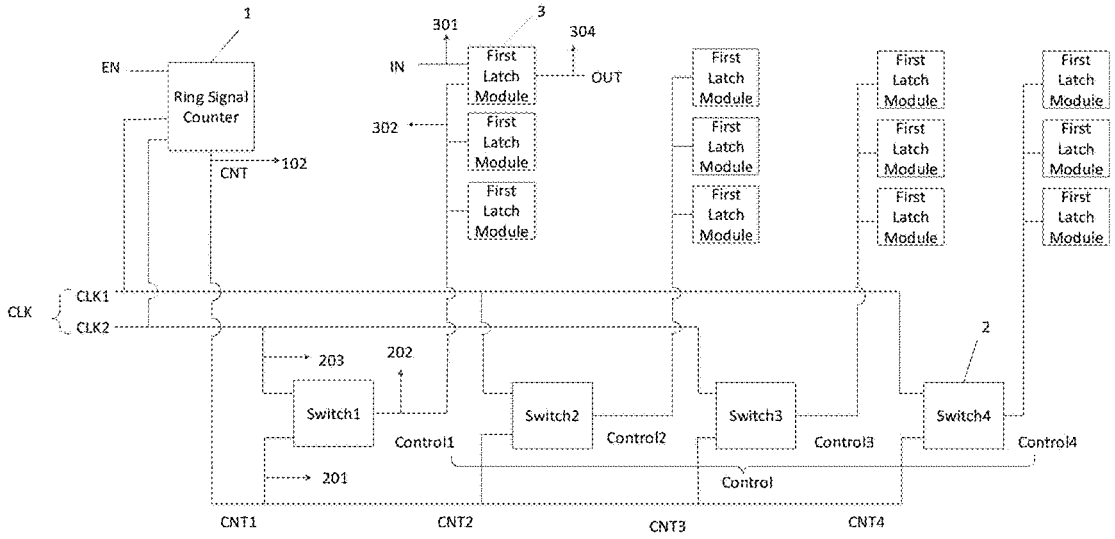
FIG. 2 is a schematic structural diagram of a data caching circuit provided by an embodiment of the present disclosure.

An embodiment of the present disclosure provides a data caching circuit. As shown in FIG. 2, the data caching circuit includes a ring signal counter 1, a plurality of switches 2, and a plurality of first latches 3.

An output terminal 101 of the ring signal counter 1 is connected to control terminals of the switches 2.

An output terminal 202 of one of the switches 2 is connected to at least one control terminal 302 of one or more of the first latches 3.

The ring signal counter 1 is configured to input a data transmission starting signal EN and a clock signal CLK, and generate and output a count control signal CNT.

A clock signal terminal 203 of the switch 2 is configured to input the clock signal CLK and the switch 2 is configured to generate and output a data caching control signal Control according to the count control signal CNT input from the control terminal 201 of the switch and the clock signal CLK.

A data signal input terminal 301 of the first latch is configured to input a data signal corresponding to a data format. The first latch 3 is configured to latch the data signal according to the data caching control signal Control input from the control terminal of the first latch. An output terminal 304 of the first latch is configured to output the data signal.

Description will be made by taking an example in which the data caching circuit shown in FIG. 2 provided in the embodiment of the present disclosure includes four switches, which are Switch1, Switch2, Switch3, and Switch4, respectively. The count control signals CNT input to Switch1, Switch2, Switch3, and Switch4 are CNT1, CNT2, CNT3, and CNT4, respectively. The data caching control signals Control output by Switch1, Switch2, Switch3, and Switch4 are Control1, Control2, Control3, and Control4, respectively.

The data caching circuit provided by the embodiment of the present disclosure can eliminate the difference between the effective number of digits in a string of data in different data formats because the ring signal counter is used to count the data in different data formats. Therefore, in a process of data transferring, only a set of count control signals is needed to control the switches to complete complex data transmission and there is no need to design a circuit generating different control signals for data in different data formats, which simplifies the circuit structure while simplifying the count control signals and also reduces the area and power consumption of the circuit.

Figure 3:
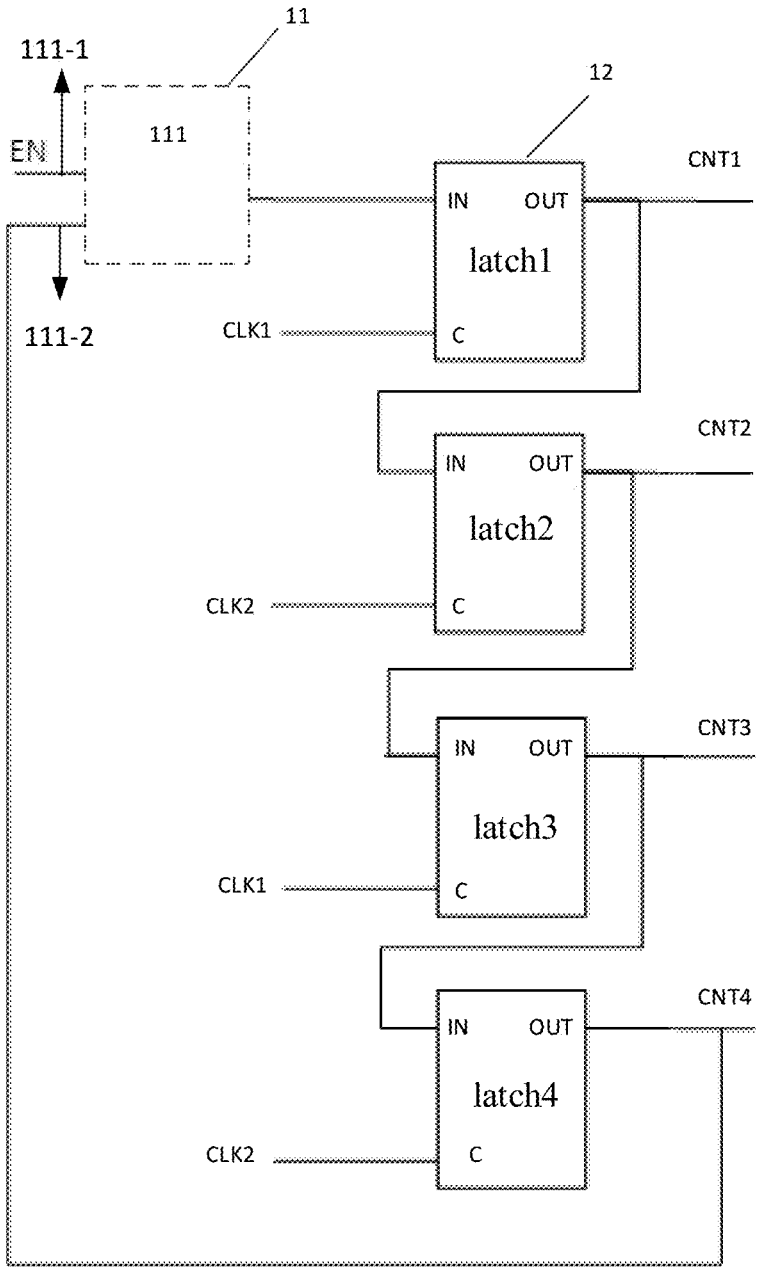
FIG. 3 is a schematic structural diagram of a ring signal counter provided by an embodiment of the present disclosure.

In an exemplary embodiment, as shown in FIG. 3, the ring signal counter includes a starter 11 and a plurality of cascaded second latches 12.

In FIG. 3, description will be made by taking an example in which the ring signal counter includes four cascaded second latches. That is, the ring signal counter is a module-4 ring signal counter. According to the example shown in FIG. 3, the four cascaded second latches are latch 1, latch 2, latch 3, and latch 4, respectively. The second latch 1 is a first stage second latch. The second latch 2 is a second stage second latch, and the previous stage second latch of the second latch 2 is the first stage second latch 1. The second latch 3 is a third stage second latch, and the previous stage second latch of the second latch 3 is the second latch 2. The second latch 4 is a fourth stage second latch, and the previous stage second latch of the second latch 4 is the second latch 3. The second latch 4 is the last stage second latch.

The starter 11 is configured to generate and output a count starting signal according to the input data transmission starting signal EN.

An input terminal IN of the second latch is connected to an output terminal of the starter 11 or an output terminal OUT of the second latch 12 of the previous stage.

An output terminal OUT of the second latch 12 is connected to the control terminal of at least one of the switches and the output terminal OUT of the second latch 12 of the last stage is connected to an input terminal of the starter 11.

Control terminals C of the plurality of cascaded second latches 12 are configured to input the clock signal CLK.

The second latch latch1 of the first stage is configured to: according to the count starting signal and the clock signal, selectively output the count control signal or a continuous low-level signal through an output terminal of the second latch of the first stage. The second latches latch2, latch3 and latch4 other than the second latch of the first stage are configured to, according to the count control signal and the clock signal output by the second latch 12 of the previous stage, selectively output the count control signal or the continuous low level signal through the output terminal of the second latch.

Clock signals CLK1 and CLK2 represent clock signals at different moments. In a specific implementation, the plurality of cascaded second latches alternately input the clock signals CLK1 and CLK2.

In an exemplary embodiment, as shown in FIG. 3, the starter includes a first OR gate 111. A first input terminal 111-1 of the first OR gate 111 is configured to input the data transmission starting signal EN, an output terminal of the first OR gate 111 is configured to output the count starting signal and a second input terminal 111-2 of the first OR gate 111 is connected to the output terminal of the second latch 12 of the last stage.

Figure 4:
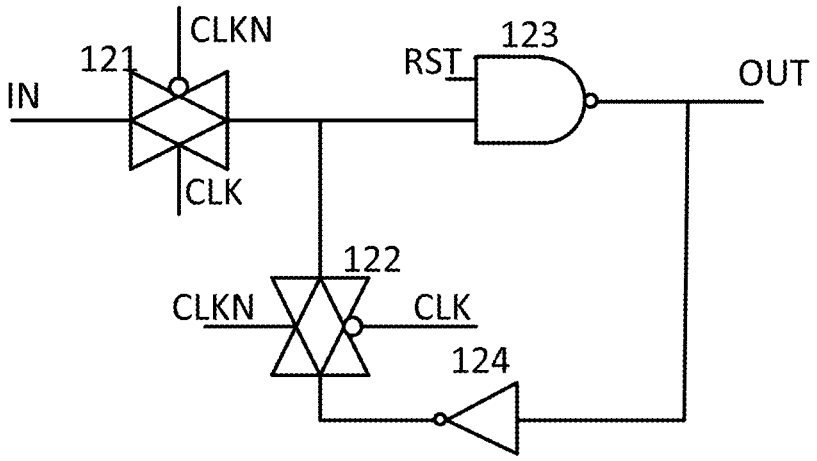
FIG. 4 is a schematic structural diagram of a second latch provided by an embodiment of the present disclosure.

As shown in FIG. 4, the second latch includes a first transmission gate 121, a second transmission gate 122, a first NAND gate 123, and a first NOT gate 124.

An input terminal IN of the first transmission gate 121 is connected to the output terminal of the first OR gate 111 or the output terminal OUT of the second latch 12 of the previous stage. A first control terminal of the first transmission gate 121 and a first control terminal of the second transmission gate 122 are configured to input the clock signal CLK. A second control terminal of the first transmission gate 121 and a second control terminal of the second transmission gate 122 are configured to input a reverse signal CLKN of the clock signal.

An output terminal of the first transmission gate 121 is connected to a second input terminal of the first NAND gate 123.

An input terminal of the second transmission gate 122 is connected to an output terminal of the first NOT gate 124 and an output terminal of the second transmission gate 122 is connected to the second input terminal of the first NAND gate 123.

A first input terminal of the first NAND gate 123 is configured to input a reset signal RST, an output terminal of the first NAND gate 123 is connected to an input terminal of the first NOT gate 124 and the output terminal OUT of the first NAND gate 123 is connected to the control terminal of the switch. The first NAND gate 123 selectively outputs the count control signal or the continuous low level signal through the output terminal OUT of the first NAND gate 123.

Figure 5:
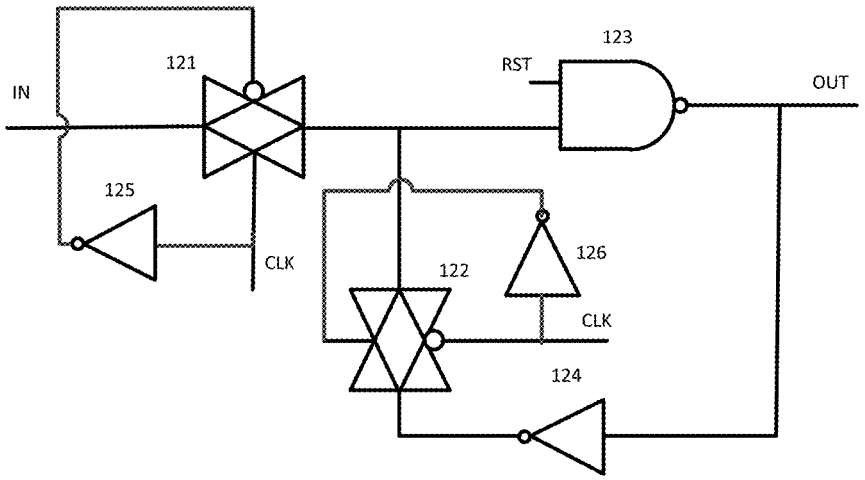
FIG. 5 is a schematic structural diagram of another second latch provided by an embodiment of the present disclosure.

In an exemplary embodiment, as shown in FIG. 5, the second latch further includes a second NOT gate 125 and a third NOT gate 126. An input terminal of the second NOT gate 125 inputs the clock signal CLK and an output terminal of the second NOT gate 125 is connected to the first control terminal of the first transmission gate 121, so that the first control terminal of the first transmission gate 121 inputs the reverse signal CLKN of the clock signal. An input terminal of the third NOT gate 126 inputs the clock signal CLK and an output terminal of the third NOT gate 126 is connected to the second control terminal of the second transmission gate 122, so that the second control terminal of the second transmission gate 122 inputs the reverse signal CLKN of the clock signal.

Specifically, when the data transmission starting signal EN is a high level signal, the ring signal counter is triggered to start counting, the output terminal of the starter 11 outputs the high level signal and the input terminal of the first transmission gate 121 inputs the high level signal. When the first transmission gate is turned on and the second transmission gate is turned off, a signal input from the input terminal IN of the first transmission gate 121 is output through the output terminal OUT of the second latch.

Figure 6:
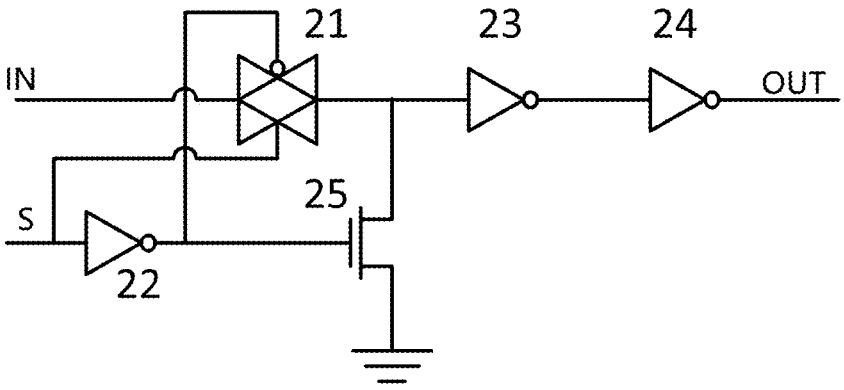
FIG. 6 is a schematic structural diagram of a switch provided by an embodiment of the present disclosure.

In an exemplary embodiment, as shown in FIG. 6, the switch includes a third transmission gate 21, a fourth NOT gate 22, a fifth NOT gate 23, a sixth NOT gate 24, and a first transistor 25.

An input terminal IN of the third transmission gate 21 is configured to input the clock signal, a first control terminal of the third transmission gate 21 is connected to an output terminal of the fourth NOT gate 22, a second control terminal of the third transmission gate 21 is connected to an input terminal of the fourth NOT gate 22 and an output terminal of the third transmission gate 21 is connected to an input terminal of the fifth NOT gate 23.

The input terminal S of the fourth NOT gate 22 is connected to the output terminal of the second latch.

An output terminal of the fifth NOT gate 23 is connected to an input terminal of the sixth NOT gate 24.

A control electrode of the first transistor 25 is connected to the output terminal of the fourth NOT gate 22, a first electrode of the first transistor 25 is connected to the input terminal of the fifth NOT gate 23 and a second electrode of the first transistor 25 is grounded.

An output terminal of the sixth NOT gate 24 is connected to the control terminal of the first latch and the sixth NOT gate 24 is configured to selectively output the clock signal or the continuous low level signal through the output terminal of the sixth NOT gate 24.

Specifically, when the input terminal S of the fourth NOT gate 22 inputs a high level signal, the control electrode of the first transistor 25 inputs a low level, the first transistor 25 is turned off, the third transmission gate 21 is turned on and the clock signal input from the input terminal IN of the third transmission gate 21 is transmitted to the output terminal OUT of the sixth NOT gate 24 to be output through a buffer comprised of the fifth NOT gate 23 and the sixth NOT gate 24. When the input terminal S of the fourth NOT gate 22 receives a low level signal, the control electrode of the first transistor 25 inputs a high level, the first transistor 25 is turned on, the third transmission gate 21 is turned off and the output terminal OUT of the sixth NOT gate 24 outputs the continuous low level signal.

In an exemplary embodiment, in the data caching circuit provided in the embodiment of the present disclosure, the number of the switches is equal to an integer multiple of the number of the second latches.

For example, when the ring signal counter includes four second latches, the data caching circuit may include 4M switches, M is an integer greater than 0 and the output terminal of each of the second latches is connected to M switches.

In an exemplary embodiment, in the data caching circuit provided by the embodiment of the present disclosure, the number of the switches is equal to the number of the second latches; and the output terminals of the second latches are connected to a control terminal of one of the switches.

In this way, the number of the switches is minimized and the number of the first latches is also minimized since each of the switches is connected to the plurality of first latches. Therefore, the number of logic devices in the data caching circuit as well as the area and power consumption of the data caching circuit may be reduced to the maximum extent.

Figure 7:
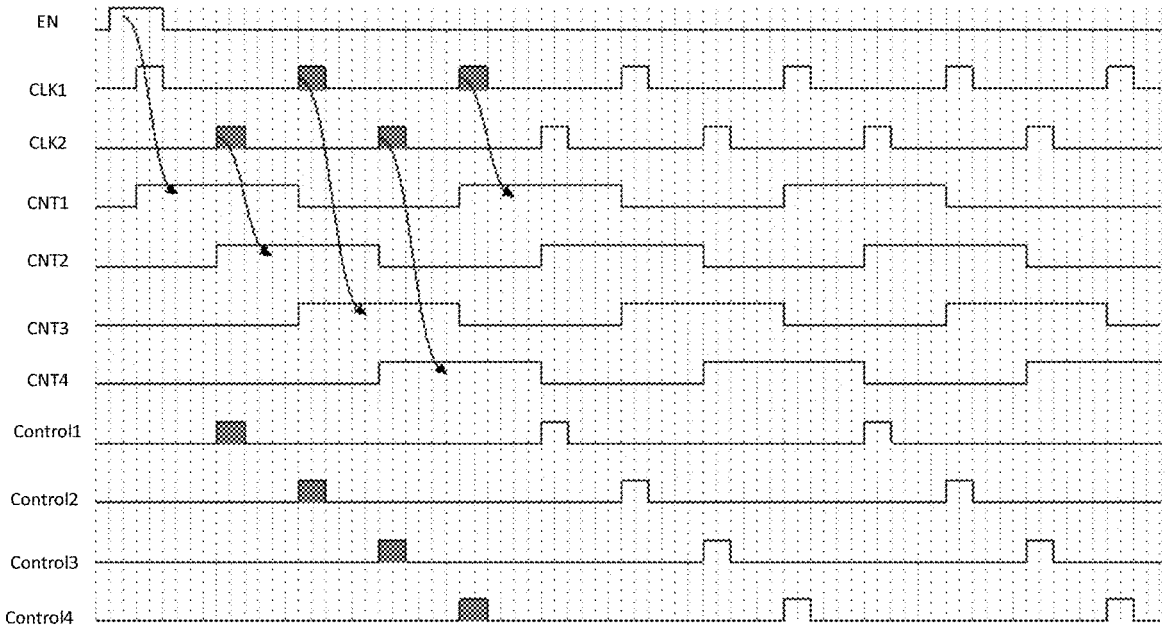
FIG. 7 is a timing diagram of a data caching circuit provided by an embodiment of the present disclosure.

Taking the ring signal counter including four second latches as an example, in a specific implementation, as shown in FIGS. 2 and 3, the data caching circuit includes four switches, which are Switch1, Switch2, Switch3, and Switch4, respectively, wherein latch1 is connected to Switch1, latch2 is connected to Switch2, latch3 is connected to Switch3 and latch4 is connected to Switch4. When a clock signal input from the second latch is CLK1, the clock signal terminal of the switch connected to the second latch inputs CLK2; and when the clock signal input from the second latch is CLK2, the clock signal terminal of the switch connected to the second latch inputs CLK1. When the data caching circuit includes four second latches and four switches, a sequence of the data caching circuit is shown in FIG. 7.

In an exemplary embodiment, as shown in FIG. 1, in the data caching circuit provided by the embodiment of the present disclosure, the output terminal of each of the switches 2 is connected to the control terminals of three first latches 3.

In an exemplary embodiment, the first latch includes a one-out-of-N data selector and a first logic combiner.

The one-out-of-N data selector includes N first AND gates, N fourth transmission gates and N seventh NOT gates.

The first logic combiner includes a second NAND gate, an eighth NOT gate, a ninth NOT gate, a fifth transmission gate and a second OR gate.

A first input terminal of the first AND gate inputs a data indication signal; and a second input terminal of the first AND gate inputs the data caching control signal.

An output terminal of each of the first AND gates is connected to a second control terminal of one of the fourth transmission gates and the output terminal of each of the first AND gates is connected to an input terminal of the seventh NOT gate.

The output terminal of the first AND gate is further connected to an input terminal of the second OR gate.

An input terminal of the fourth transmission gate is configured to input a data signal corresponding to a data format. A first control terminal of each of the fourth transmission gates is connected to an output terminal of one of the seventh NOT gates; an output terminal of the fourth transmission gate is connected to a second input terminal of the second NAND gate and the output terminal of the fourth transmission gate is connected to an input terminal of the fifth transmission gate.

An output terminal of the second OR gate is connected to an input terminal of the ninth NOT gate and the output terminal of the second OR gate is connected to a first control terminal of the fifth transmission gate; an output terminal of the fifth transmission gate is connected to an input terminal of the eighth NOT gate; and a second control terminal of the fifth transmission gate is connected to an output terminal of the ninth NOT gate.

A first input terminal of the second NAND gate is configured to input a reset signal and an output terminal of the second NAND gate is connected to the input terminal of the eighth NOT gate.

N is an integer greater than 1 and N is a total number of data formats transmitted by the ring signal counter.

That is, the input terminal of the fourth transmission gate corresponds to the data signal input terminal of the first latch, and is configured to input the data signal corresponding to the data format. The first latch further has a data indication signal input terminal. The first input terminal of the first AND gate corresponds to the data indication signal input terminal of the first latch. The second input terminal of the first AND gate corresponds to the control terminal of the first latch, and is configured to input the data caching control signal. An output terminal of the eighth NOT gate corresponds to the output terminal of the first latch, and is configured to output a data signal cached by the first latch.

Figure 8:
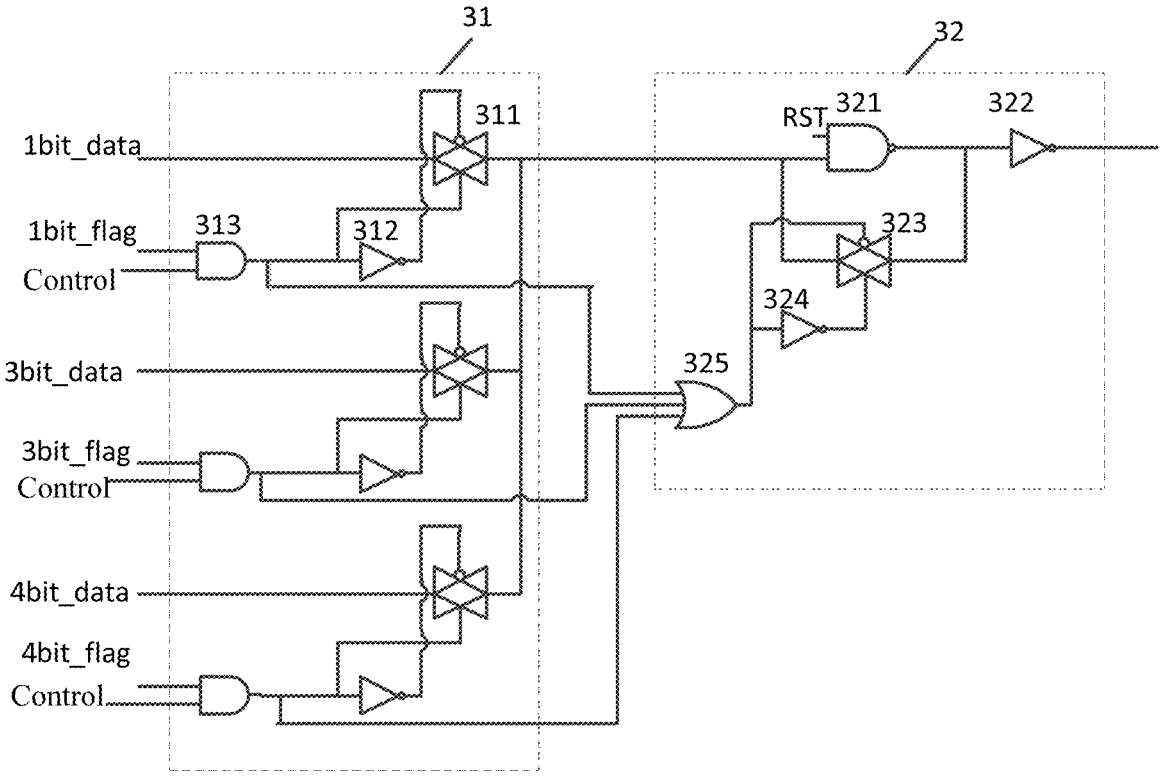
FIG. 8 is a schematic structural diagram of a first latch provided by an embodiment of the present disclosure.

Next, the first latches in the data caching circuit provided by the embodiment of the present disclosure will be described by way of example in which the ring signal counter transmits data in three formats of a 1 bit mode, a 3 bit mode and a 4 bit mode, that is, N is equal to 3. As shown in FIG. 8, the first latch includes a one-out-of-three data selector 31 and a first logic combiner 32.

The one-out-of-three data selector 31 includes three first AND gates 313, three fourth transmission gates 311 and three seventh NOT gates 312.

The first logic combiner 32 includes a second NAND gate 321, an eighth NOT gate 322, a ninth NOT gate 324, a fifth transmission gate 323, and a second OR gate 325.

First input terminals of the three first AND gates 313 input data indication signals 1 bit_flag, 3 bit_flag and 4 bit_flag, respectively. Second input terminals of the first AND gates 313 input a data caching control signal Control. An output terminal of each of the first AND gates 313 is connected to a second control terminal of one of the fourth transmission gates 311 and the output terminal of each of the first AND gates 313 is connected to an input terminal of one of the seventh NOT gates 312. The output terminals of the three first AND gates 313 are connected to an input terminal of the second OR gate.

An input terminal of the fourth transmission gate 311 is configured to input a data signal corresponding to a data format and the input terminals of the three fourth transmission gates 311 input 1 bit_data, 3 bit_data, and 4 bit_data, respectively. A first control terminal of each of the fourth transmission gates 311 is connected to an output terminal of one of the seventh NOT gates 312. An output terminal of the fourth transmission gate 311 is connected to a second input terminal of the second NAND gate 321 and the output terminal of the fourth transmission gate 311 is connected to an input terminal of the fifth transmission gate 323.

An output terminal of the second OR gate 325 is connected to an input terminal of the ninth NOT gate 324 and the output terminal of the second OR gate 325 is connected to a first control terminal of the fifth transmission gate 323. An output terminal of the fifth transmission gate 323 is connected to an input terminal of the eighth NOT gate 322; and a second control terminal of the fifth transmission gate 323 is connected to an output terminal of the ninth NOT gate 324.

A first input terminal of the second NAND gate 321 is configured to input a reset signal RST and an output terminal of the second NAND gate 321 is connected to the input terminal of the eighth NOT gate 322.

Specifically, in the embodiment of the present disclosure, for data of each data format, when the first AND gate 313 outputs a high level, the fourth transmission gate 311 is turned on to input the data signal corresponding to the data format to the second input terminal of the second NAND gate 321. When signals of the output terminals of the three first AND gates are all at a low level, a signal input from the second control terminal of the fifth transmission gate is at a high level and the fifth transmission gate 323 is turned on. An output terminal of the eighth NOT gate 322 is configured to output data cached by the data caching circuit. The reset signal RST input at the first input terminal of the second NAND gate 321 is active at a low level and when the reset signal RST is a low level signal, the first latch is reset to zero.

In an exemplary embodiment, in the data caching circuit provided by the embodiment of the present disclosure, the ring signal counter includes four stages of second latches, the data caching circuit includes 4 switches and the first latch includes a one-out-of-three data selector.

It should be noted that, under normal circumstances, for a data caching circuit in a display product, the data format includes three types of data formats of a 1 bit mode, a 3 bit mode, and a 4 bit mode. When data in the three data formats needs to be transmitted, the ring signal counter includes four stages of second latches, that is, when the module value of the ring signal counter is 4, the number of components of the ring signal counter is minimized. Correspondingly, the number of the required switches is minimized, the number of the required first latches is minimized and the number of logic devices in the one-our-of-N data selector is also minimized. When data in the 1 bit mode, the 3 bit mode and the 4 bit mode need to be transmitted and cached, the data caching circuit provided by the embodiment of this application only needs to provide a module-4 ring signal counter, four switches and 12 first latches and in the first latch, only a one-out-of-three data selector needs to be provided. In the solution of the prior art, however, two kinds of counters, 17 switches and a one-out-of-six latch need to be provided. Compared with the prior art, the data caching circuit provided by the embodiment of the present disclosure can greatly reduce the number of circuit logic devices and the area and power consumption of the circuit.

Giving an example in which the data formats transmitted by the data caching circuit include a 1 bit mode, a 3 bit mode and a 4 bit mode, a data transmission cycle for the data caching circuit provided by the embodiment of the present disclosure will be described by way of example. For transmission in the 3 bit mode, 12 serves as one transmission cycle and 12 bit data are transferred during one transmission cycle. In the 4 bit mode, 16 serves as one transmission cycle, but only 3 data in every 4 data are valid, so $16\times\frac{3}{4}=12$ bit data are transferred during one transmission cycle. In the 1 bit mode, 4 serves as one transmission cycle, but each data will be transmitted as 3 valid data, so $4\times3=12$ bit data will be transmitted in one transmission cycle. That is, in different data formats, using the data caching circuit provided by the embodiment of the present disclosure, the data volume that needs to be transmitted is actually the same. Therefore, different modes may be multiplexed, so that the data in different data formats may be transmitted and cached by the same control path consisted of the ring signal counter, the switches and the first latches.

A display panel provided by an embodiment of the present disclosure includes the above-mentioned data caching circuit provided by the embodiment of the present disclosure.

In an exemplary embodiment, the display panel further includes a serial-to-parallel conversion circuit and a pixel circuit. The input terminal of the ring signal counter is connected to an output terminal of the serial-to-parallel conversion circuit and the output terminal of the first latch is connected to the pixel circuit.

Specifically, in the embodiment of the present disclosure, a data transmission starting signal EN, a clock signal CLK, data indication signals 1 bit_flag, 3 bit_flag, and 4 bit_flag as well as data signals 1 bit_data, 3 bit_data, 4 bit_data corresponding to data formats may all be output through the serial-to-parallel conversion circuit. Data output from an output terminal of the data caching circuit is input to the pixel circuit as data stored in pixels.

Taking an example in which the data caching circuit includes four stages of second latch, 4 switches and 12 first latches, which include a one-out-of-three data selector. In a specific implementation, 16 data lines may be provided for connection between the serial-to-parallel conversion circuit and the data caching circuit and the 16 data lines are named d15~d0, respectively. For a 3 bit mode, 12 data lines, for example d0~d11, are connected to 3 bit_data ends of 12 one-out-of-three latches, respectively, to sort data in the 3 bit mode. For a 4 bit mode, 12 data lines, for example d15~d13, d11~d9, d7~d5 and d3~d1, are connected to 4 bit_data ends of 12 one-out-of-three latches, respectively, to sort data in the 4 bit mode, and in this case, d12, d8, d4 and d0 are dummy data, and the transmitted data is not latched. For a 1 bit mode, each of 4 data lines, for example d3-d0, is connected to 1 bit_data ends of 3 one-out-of-three latches in one column, respectively, to sort data in the 1 bit mode.

A display device provided by an embodiment of the present disclosure includes the display panel provided by the embodiment of the present disclosure.

The display device provided by the embodiment of the present disclosure may be, for example, a mobile phone, a TV, a computer, and other devices.

In summary, the data caching circuit, the display panel and the display device provided by the embodiment of the present disclosure only need a set of count control signals to control the switches to complete complex data transmission during data transferring since the ring signal counter is used to count the data in different data formats and there is no need to design a circuit that generates different control signals for data in different data formats, which simplifies the circuit structure while simplifying the count control signals and also reduces the area and power consumption of the circuit.

Understandably, various changes and modifications can be made by those skilled in the art without departing from the spirit and scope of the present disclosure. In this way, if the variations and modifications of the present disclosure fall within the scope of the claims and their equivalent technologies of the present disclosure, it is intended that the present disclosure includes the variations and modifications.

What is claimed is:

1. A data caching circuit, comprising:

a ring signal counter, a plurality of switches, and a plurality of first latches, wherein:

an output terminal of the ring signal counter is connected to control terminals of the switches, and the ring signal counter is configured to input a data transmission starting signal and a clock signal, and generate and output a count control signal to the control terminals of the plurality of switches;

a clock signal terminal of a switch of the plurality of switches is configured to input the clock signal, and the switch is configured to generate and output a data caching control signal according to the count control signal input from the control terminal of the switch and the clock signal input from the clock signal terminal;

an output terminal of the switch of the plurality of switches is connected to at least one control terminal of at least one of the plurality of first latches, and is configured to output the data caching control signal to the at least one control terminal of the at least one of the plurality of the first latches; and a data signal input terminal of the first latch is configured to input a data signal corresponding to a data format, the first latch is configured to latch the data signal according to the data caching control signal input from the control terminal of the first latch, and an output terminal of the first latch is configured to output the data signal.

2. The data caching circuit according to claim 1, wherein:

the ring signal counter comprises a starter and a plurality of cascaded second latches, the starter being configured to generate and output a count starting signal according to the input data transmission starting signal;

an input terminal of a first stage second latch of the plurality of cascaded second latches is connected to an output terminal of the starter;

an input terminal of second latches other than the first stage second latch of the plurality of cascaded second latches is connected to an output terminal of the second latch of their previous stage of the plurality of cascaded second latches;

an output terminal of a last stage second latch of the plurality of cascaded second latches is connected to an input terminal of the starter, and an input terminal of the second latches other than the last stage second latch is connected to the control terminal of at least one of the switches;

control terminals of the plurality of cascaded second latches are configured to input the clock signal;

the first stage second latch of the plurality of cascaded second latches is configured to, according to the count starting signal and the clock signal, selectively output the count control signal or a continuous low level signal through the output terminal of the first stage second latch; and the second latches other than the first stage second latch are configured to, according to the count control signal and the clock signal output by the second latch of their previous stage, selectively output the count control signal or the continuous low level signal through the output terminal of the second latch.

3. The data caching circuit according to claim 2, wherein:

the starter comprises a first OR gate, wherein the first OR gate has a first input terminal configured to input the data transmission starting signal, an output terminal configured to output a count starting signal, and a second input terminal connected to the output terminal of the last stage second latch;

the second latch comprises a first transmission gate, a second transmission gate, a first NAND gate, and a first NOT gate;

an input terminal of the first transmission gate of the first stage second latch of the plurality of cascaded second latches is connected to the output terminal of the first OR gate, an input terminal of second latches other than the first stage second latch of the plurality of cascaded second latches is connected to the output terminal of the second latch of their previous stage, a first control terminal of the first transmission gate and a first control terminal of the second transmission gate are configured to input the clock signal, and a second control terminal of the first transmission gate and a second control terminal of the second transmission gate are configured to input a reverse signal of the clock signal;

an output terminal of the first transmission gate is connected to a second input terminal of the first NAND gate;

an input terminal of the second transmission gate is connected to an output terminal of the first NOT gate, and an output terminal of the second transmission gate is connected to the second input terminal of the first NAND gate; and a first input terminal of the first NAND gate is configured to input a reset signal, an output terminal of the first NAND gate is connected to an input terminal of the first NOT gate, and the first NAND gate selectively outputs the count control signal or the continuous low level signal through the output terminal of the first NAND gate.

4. The data caching circuit according to claim 2, wherein:

the switch comprises a third transmission gate, a fourth NOT gate, a fifth NOT gate, a sixth NOT gate, and a first transistor, the third transmission gate has an input terminal configured to input the clock signal, a first control terminal connected to an output terminal of the fourth NOT gate, a second control terminal connected to an input terminal of the fourth NOT gate, and an output terminal connected to an input terminal of the fifth NOT gate;

the input terminal of the fourth NOT gate is connected to the output terminal of the second latch;

an output terminal of the fifth NOT gate is connected to an input terminal of the sixth NOT gate;

the first transistor has a control electrode connected to the output terminal of the fourth NOT gate, a first electrode connected to the input terminal of the fifth NOT gate, and a second electrode which is grounded; and an output terminal of the sixth NOT gate is connected to the control terminal of the first latch and the sixth NOT gate is configured to selectively output the clock signal or the continuous low level signal through the output terminal of the sixth NOT gate.

5. The data caching circuit according to claim 2, wherein the number of the switches is equal to the number of the second latches, and the output terminal of the second latch is connected to the control terminal of one of the switches.

6. The data caching circuit according to claim 1, wherein the output terminal of each of the switches is connected to control terminals of three of the first latches of the plurality of first latches.

7. The data caching circuit according to claim 6, wherein:

the first latch comprises a one-out-of-N data selector and a first logic combiner, the one-out-of-N data selector comprises N first AND gates, N fourth transmission gates and N seventh NOT gates;

the first logic combiner comprises a second NAND gate, an eighth NOT gate, a ninth NOT gate, a fifth transmission gate and a second OR gate;

a first input terminal of the first AND gate inputs a data indication signal; a second input terminal of the first AND gate inputs the data caching control signal; an output terminal of each of the first AND gates is connected to a second control terminal of one of the fourth transmission gates, and the output terminal of each of the first AND gates is connected to an input terminal of one of the seventh NOT gates; the output terminal of the first AND gate is connected to an input terminal of the second OR gate;

an input terminal of the fourth transmission gate is configured to input the data signal corresponding to the data format; a first control terminal of each of the fourth transmission gates is connected to an output terminal of one of the seventh NOT gates; an output terminal of the fourth transmission gate is connected to a second input terminal of the second NAND gate, and the output terminal of the fourth transmission gate is connected to an input terminal of the fifth transmission gate;

an output terminal of the second OR gate is connected to an input terminal of the ninth NOT gate, and the output terminal of the second OR gate is connected to a first control terminal of the fifth transmission gate; an output terminal of the fifth transmission gate is connected to an input terminal of the eighth NOT gate; a second control terminal of the fifth transmission gate is connected to an output terminal of the ninth NOT gate;

a first input terminal of the second NAND gate is configured to input a reset signal, and an output terminal of the second NAND gate is connected to the input terminal of the eighth NOT gate; and N is an integer greater than 1 and N is a total number of data formats transmitted by the ring signal counter.

8. The data caching circuit according to claim 7, wherein the ring signal counter comprises four stages of second latches, the data caching circuit comprises four switches, and the first latch comprises a one-out-of-three data selector.

9. A display panel, comprising:

a data caching circuit comprising a ring signal counter, a plurality of switches, and a plurality of first latches, wherein:

an output terminal of the ring signal counter is connected to control terminals of the switches, and the ring signal counter is configured to input a data transmission starting signal and a clock signal, and generate and output a count control signal to the control terminals of the plurality of switches;

a clock signal terminal of a switch of the plurality of switches is configured to input the clock signal, and the switch is configured to generate and output a data caching control signal according to the count control signal input from the control terminal of the switch and the clock signal input from the clock signal terminal;

an output terminal of the switch of the plurality of switches is connected to at least one control terminal of at least one of the plurality of first latches, and is configured to output the data caching control signal to the at least one control terminal of the at least one of the plurality of the first latches; and a data signal input terminal of the first latch is configured to input a data signal corresponding to a data format, the first latch is configured to latch the data signal according to the data caching control signal input from the control terminal of the first latch, and an output terminal of the first latch is configured to output the data signal.

10. The display panel according to claim 9, wherein:

the ring signal counter comprises a starter and a plurality of cascaded second latches, the starter being configured to generate and output a count starting signal according to the input data transmission starting signal;

an input terminal of a first stage second latch of the plurality of cascaded second latches is connected to an output terminal of the starter;

an input terminal of second latches other than the first stage second latch of the plurality of cascaded second latches is connected to an output terminal of the second latch of their previous stage of the plurality of cascaded second latches;

an output terminal of a last stage second latch of the plurality of cascaded second latches is connected to an input terminal of the starter, an input terminal of the second latches other than the last stage second latch is connected to the control terminal of at least one of the switches;

control terminals of the plurality of cascaded second latches are configured to input the clock signal;

the first stage second latch of the plurality of cascaded second latches is configured to, according to the count starting signal and the clock signal, selectively output the count control signal or a continuous low level signal through the output terminal of the first stage second latch; and the second latches other than the first stage second latch are configured to, according to the count control signal and the clock signal output by the second latch of their previous stage, selectively output the count control signal or the continuous low level signal through the output terminal of the second latch.

11. The display panel according to claim 10, wherein:

the starter comprises a first OR gate, the first OR gate has a first input terminal configured to input the data transmission starting signal, an output terminal configured to output a count starting signal, and a second input terminal connected to the output terminal of the last stage second latch;

the second latch comprises a first transmission gate, a second transmission gate, a first NAND gate and a first NOT gate;

an input terminal of the first transmission gate of the first stage second latch of the plurality of cascaded second latches is connected to the output terminal of the first OR gate, an input terminal of second latches other than the first stage second latch of the plurality of cascaded second latches is connected to the output terminal of the second latch of their previous stage, a first control terminal of the first transmission gate and a first control terminal of the second transmission gate are configured to input the clock signal, and a second control terminal of the first transmission gate and a second control terminal of the second transmission gate are configured to input a reverse signal of the clock signal;

an output terminal of the first transmission gate is connected to a second input terminal of the first NAND gate;

an input terminal of the second transmission gate is connected to an output terminal of the first NOT gate, and an output terminal of the second transmission gate is connected to the second input terminal of the first NAND gate; and a first input terminal of the first NAND gate is configured to input a reset signal, an output terminal of the first NAND gate is connected to an input terminal of the first NOT gate, and the first NAND gate selectively outputs the count control signal or the continuous low level signal through the output terminal of the first NAND gate.

12. The display panel according to claim 10, wherein:

the switch comprises a third transmission gate, a fourth NOT gate, a fifth NOT gate, a sixth NOT gate, and a first transistor;

the third transmission gate has an input terminal configured to input the clock signal, a first control terminal connected to an output terminal of the fourth NOT gate, a second control terminal connected to an input terminal of the fourth NOT gate, and an output terminal connected to an input terminal of the fifth NOT gate;

the input terminal of the fourth NOT gate is connected to the output terminal of the second latch;

an output terminal of the fifth NOT gate is connected to an input terminal of the sixth NOT gate;

the first transistor has a control electrode connected to the output terminal of the fourth NOT gate, a first electrode connected to the input terminal of the fifth NOT gate, and a second electrode which is grounded; and an output terminal of the sixth NOT gate is connected to the control terminal of the first latch and the sixth NOT gate is configured to selectively output the clock signal or the continuous low level signal through the output terminal of the sixth NOT gate.

13. The display panel according to claim 10, wherein the number of the switches is equal to the number of the second latches, and the output terminal of the second latch is connected to the control terminal of one of the switches.

14. The display panel according to claim 9, wherein the output terminal of each of the switches is connected to control terminals of three of the first latches.

15. The display panel according to claim 14, wherein:

the first latch comprises a one-out-of-N data selector and a first logic combiner;

the one-out-of-N data selector comprises N first AND gates, N fourth transmission gates and N seventh NOT gates;

the first logic combiner comprises a second NAND gate, an eighth NOT gate, a ninth NOT gate, a fifth transmission gate, and a second OR gate;

a first input terminal of the first AND gate inputs a data indication signal; a second input terminal of the first AND gate inputs the data caching control signal; an output terminal of each of the first AND gates is connected to a second control terminal of one of the fourth transmission gates, and the output terminal of each of the first AND gates is connected to an input terminal of one of the seventh NOT gates; the output terminal of the first AND gate is connected to an input terminal of the second OR gate;

an input terminal of the fourth transmission gate is configured to input the data signal corresponding to the data format; a first control terminal of each of the fourth transmission gates is connected to an output terminal of one of the seventh NOT gates; an output terminal of the fourth transmission gate is connected to a second input terminal of the second NAND gate, and the output terminal of the fourth transmission gate is connected to an input terminal of the fifth transmission gate;

an output terminal of the second OR gate is connected to an input terminal of the ninth NOT gate, and the output terminal of the second OR gate is connected to a first control terminal of the fifth transmission gate; an output terminal of the fifth transmission gate is connected to an input terminal of the eighth NOT gate; a second control terminal of the fifth transmission gate is connected to an output terminal of the ninth NOT gate;

a first input terminal of the second NAND gate is configured to input a reset signal, and an output terminal of the second NAND gate is connected to the input terminal of the eighth NOT gate; and N is an integer greater than 1 and N is a total number of data formats transmitted by the ring signal counter.

16. The display panel according to claim 15, wherein the ring signal counter comprises four stages of second latches, the data caching circuit comprises four switches, and the first latch comprises a one-out-of-three data selector.

17. A display device, comprising:

a display panel having a data caching circuit, the data caching circuit comprising a ring signal counter, a plurality of switches, and a plurality of first latches, wherein:

an output terminal of the ring signal counter is connected to control terminals of the switches, and the ring signal counter is configured to input a data transmission starting signal and a clock signal, and generate and output a count control signal to the control terminals of the plurality of switches;

a clock signal terminal of a switch of the plurality of switches is configured to input the clock signal, and the switch is configured to generate and output a data caching control signal according to the count control signal input from the control terminal of the switch and the clock signal input from the clock signal terminal;

an output terminal of the switch of the plurality of switches is connected to at least one control terminal of at least one of the plurality of first latches, and is configured to output the data caching control signal to the at least one control terminal of the at least one of the plurality of the first latches; and a data signal input terminal of the first latch is configured to input a data signal corresponding to a data format, the first latch is configured to latch the data signal according to the data caching control signal input from the control terminal of the first latch, and an output terminal of the first latch is configured to output the data signal.

* * * * *